United States Patent [19]

Klotz et al.

[11] 4,152,226

[45] May 1, 1979

[54] PROCESS AND APPARATUS FOR MONITORING AMALGAM ELECTROLYSIS CELLS

[75] Inventors: Helmut Klotz; Hans D. Pinter, both of Bergisch Gladbach; Walter Kornfeld, Leverkusen; Wolfgang Isenhagen, Cologne, all of Fed. Rep. of Germany

[73] Assignee: Bayer Aktiengesellschaft, Leverkusen, Fed. Rep. of Germany

[21] Appl. No.: 869,065

[22] Filed: Jan. 12, 1978

[30] Foreign Application Priority Data

Jan. 29, 1977 [DE] Fed. Rep. of Germany ..... 2703711

[51] Int. Cl.[2] ..... C25B 1/36; C25B 15/02

[52] U.S. Cl. ..... 204/99; 204/1 T; 204/250

[58] Field of Search ..... 204/1 A, 99, 250

[56] References Cited

PUBLICATIONS

"EMF Measurements of Na Activity in Na Amalgam with Beta-Alumina" by Hsueh et al., J. Electrochem Soc., Jul. 1971, pp. 1128-1130.

"Anisotropic Electrochem Conc., Cell—", by Thomas et al., J. Materials Science, vol. 7, 1972, pp. 838-840.

*Primary Examiner*—R. L. Andrews

*Attorney, Agent, or Firm*—Sprung, Felfe, Horn, Lynch & Kramer

[57] ABSTRACT

The sodium concentration in the amalgam of an electrolysis cell is automatically monitored by periodically removing an amalgam sample of predetermined quantity from the end compartment of the electrolysis cell, introducing the sample into a reference cell containing a reference electrolyte, thereby to form a galvanic element in said reference cell, discharging the galvanic element, and measuring the charge flowing out when the galvanic element is discharged, the charge being an index of the sodium concentration. Advantageously the reference electrolyte is a dilute solution of at least one of sodium hydroxide and sodium chloride. The apparatus includes many cells and a common distant monitoring station. A voltage which is proportional to the decomposition current of the galvanic element formed by the amalgam and reference electrolyte is fed to the input of a voltage/frequency converter which determines the charge, and the output of the converter is integrated by a subsequent counter chain until the decomposition current is damped.

7 Claims, 2 Drawing Figures

PROCESS AND APPARATUS FOR MONITORING AMALGAM ELECTROLYSIS CELLS

Figure 1:
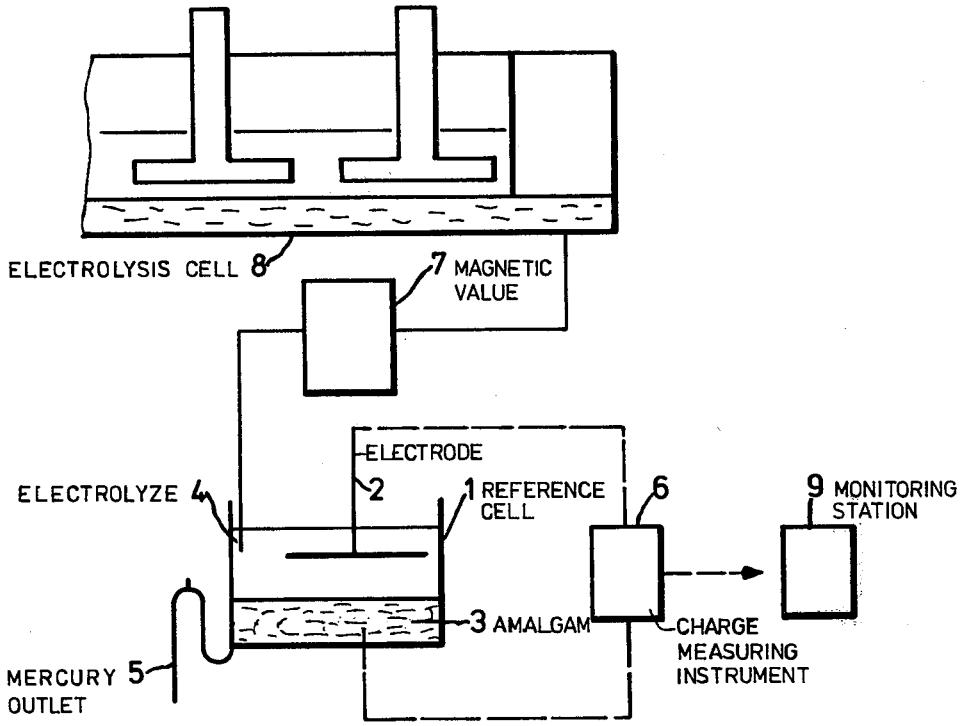
Figure 2:
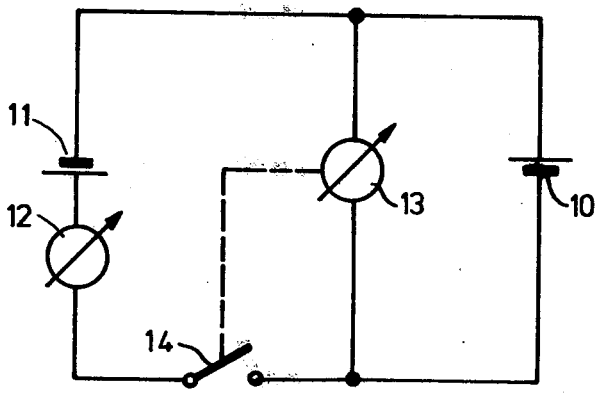

The present invention relates to a method of automatically monitoring electrolysis cells, in particular monitoring the sodium concentration in mercuric amalgam during sodium chloride electrolysis. In order for alkali chloride electrolysis with an amalgam cathode to function without disturbances it is necessary to ensure that the sodium concentration in the amalgam does not exceed a specific value. This value is given in the literature as from 0.25 to 0.35% of sodium in the amalgam (Ullmann, Encyclopaedia, 4th edition, volume 9, page 342 (1975)). It is therefore frequently necessary to monitor the sodium concentration.

The sodium concentration is usually measured during operation in an absorption burette by gas volumetric analysis by determing the amount of hydrogen formed when the amalgam is decomposed by means of acids. The amalgam is removed from the end compartment of the electrolysis cell using a pipette (Ullman, see above). In addition, titration methods are also known for determining sodium concentrations. In these known methods, the sodium concentration is determined after taking samples manually from each cell at regular intervals. In the large electrolysis installations containing over two hundred electrolysis cells, which are common nowadays, this represents a considerable effort.

Automation of sampling and sodium concentration determination, during which the sodium concentration is produced as a measured electrical parameter which may be conveyed to a distant monitoring station and there optionally be recorded by an electronic data processing unit and monitored, is therefore a pressing concern of the art.

Commercially available automatic titration devices for use in analytical laboratories (H. Rodicker, K. Geier; Physico-Chemical methods of research, Leipzig 1962, page 140 et seq) could theoretically be used but they are disproportionately expensive owing to the large number required and the low degree of accuracy required when monitoring cells. Rather, the object of the invention demands a simple and robust solution which ensures sufficient accuracy for technical operation.

The present invention therefore relates to a method of and apparatus for automatically monitoring the sodium concentration in the amalgam of electrolysis cells, which is characterized in that samples of amalgam of predetermined quantity are periodically removed separately from the end compartments of each electrolysis cell, are introduced into a cell containing a reference electrolyte, and the charge from the galvanic element so formed is measured during discharge thereof.

For a given quantity of amalgam the measured charge is correlated directly with the sodium concentration in the amalgam, using Faraday's laws. In theory the sample can be measured by weighing. However, it is preferable to measure the volume of the sample. This may be effected by actuating inlet and outlet valves at the appropriate times through electrial contacts which are provided in the measurement cell and which make contact with the mercury. It is particularly simple to operate by adjusting the level of the amalgam in the measurement cell using a syphon. In this case, only one inlet valve is required. Sufficient amalgam is then fed before each measuring operation for the amalgam of the previous measuring operation to be displaced and washed away. The inlet valve may, for example, be closed only for the duration of the measuring operation. Piston pumps or gear pumps are suitable for supplying the amalgam, particularly if the measurement cell lies above the level of the electrolysis cell. Electrolytes which have a pH of about 7 to 14 and which are inert towards sodium amalgam, are suitable for the reference electrolyte. Dilute caustic soda or sodium chloride solution or mixtures thereof are preferably used.

The charge which is released when the galvanic element sodium amalgam/reference electrolyte is discharged is determined by integrating the intensity of current over time. Particular demands are imposed upon the measuring process owing to the small volume of the amalgam sample and to falling level of the current during the discharge of the galvanic element. It has been found that sufficient accuracy and reproducibility can be ensured by the following measuring procedure. A voltage which is proportional to the decomposition current is obtained via a manganin shunt at constant temperature and is fed to the input of a voltage/frequency converter with good linear behavior. The output frequency of the voltage/frequency converter is proportional to the decomposition current and is integrated by means of a counting chain until the decomposition current has been damped. The counted value is displayed digitally as a measure for the charge given off by the element.

In a preferred embodiment of the present invention the discharge-current of the galvanic element is supported by connecting an auxiliary voltage source to the galvanic element, so reducing the time necessary for one measurement significantly. The auxiliary voltage should amount to about 2 to 5 Volt, preferably about 3,5 V. After the galvanic element has been discharged, the auxiliary voltage has to be disconnected. This can be done automatically with respect to the voltage increase at the moment at which the galvanic element is discharged, e.g. by a thyristor circuit, which is well known in the art.

The measured value obtained is preferably transmitted to a distant monitoring station and displayed and monitored therein.

In a particularly preferred embodiment of the present invention, the decomposition current or the voltage which is proportional to the decomposition current is transmitted to a distant monitoring station and there fed to the input of the voltage/frequency converter. It is particularly advantageous to only use one voltage/frequency converter and only one counting chain for a plurality of electrolysis cells, by connecting the individual measurement cells, each of which is allocated to a respective electrolysis cell, sequentially via a multiplex switch to the input of the voltage/frequency converter. The valves or pumps which regulate the supply of the amalgam samples to the measurement cell are connected synchronously from the monitoring position onwards. A particularly suitable method for transmitting parameters measured in electrolysis cells over long distances is described in U.S. Pat. No. 4,035,771.

The principle according to the invention is shown in more detail in the accompanying drawings which are schematic illustrations of the novel apparatus, in which the numerals have the following significance:

FIG. 1:

1. The measurement cell
2. The electrode in the reference electrolyte

3. The amalgam
4. The reference electrolyte
5. The mercury outlet
6. Charge measuring instrument for the charge
7. Magnetic valve
8. Electrolysis cell
9. Monitoring station

FIG. 2:

10. Galvanic element sodium amalgam/reference electrolyte
11. Auxiliary voltage source
12. Current intensity integrating instrument
13. Voltage meter
14. Switch, controlled by the voltage meter The operation of the apparatus is believed self-evident. While only one electrolysis cell and one reference cell are shown, a plurality can be provided and sequentially monitored. It is even possible to use only a single reference cell for a plurality of electrolysis cells but the valving and plumbing become more complex.

It will be appreciated that the instant specification and claims are set forth by way of illustration and not limitation, and that various modifications and changes may be made without departing from the spirit and scope of the present invention.

What is claimed is:

1. A method of automatically monitoring the sodium concentration in the amalgam of an electrolysis cell, comprising periodically removing an amalgam sample of predetermined quantity from the end compartment of the electrolysis cell, introducing the sample into a reference cell containing a reference electrolyte, thereby to form a galvanic element in said reference cell, discharging the galvanic element, and integrating the intensity of current over time when the galvanic element is discharged, the result being an index of the sodium concentration.

2. A method according to claim 1, wherein the reference electrolyte is a dilute solution of at least one of sodium hydroxide and sodium chloride.

3. A method according to claim 1, wherein a voltage which is proportional to the discharge current of the galvanic element formed by the amalgam and reference electrolyte is fed to the input of a voltage/frequency converter which determines the charge, and the output of the converter is integrated by a subsequent counter chain until the decomposition current is damped.

4. A method according to claim 3, wherein a plurality of electrolysis cells and respective reference cells are provided, the process involving sequentially feeding the voltage from the reference cells to a single distant monitoring station common to all the measurement cells.

5. A method according to claim 1, wherein an auxiliary voltage source is connected to the galvanic element, thereby amplifying the discharge current.

6. An apparatus for automatically monitoring the sodium concentration in the amalgam of an electrolysis cell comprising a reference cell, means for supplying an electrolyte to said reference cell, a valve between said electrolysis and reference cells, means for periodically opening said valve to permit flow of amalgam from said electrolysis cell to said reference cell, means for integrating the intensity of current over time in said reference cell, and means for removing amalgam from said reference cell after a monitoring operation.

7. An apparatus according to claim 6, including a plurality of electrolysis cells, each with a respective reference cell, valve, opening, measuring means and removing means, and a common distant monitoring station for all the reference cells.

* * * * *